US006014865A

United States Patent [19]

Kim et al.

[11] Patent Number: 6,014,865

[45] Date of Patent: Jan. 18, 2000

[54] REFRIGERATOR HAVING A DEVICE FOR PREVENTING FLOW OF AIR BETWEEN AN EVAPORATOR AND A COOLING COMPARTMENT

[75] Inventors: Jae-in Kim, Seoul; Han-joo Yoo, Suwon, both of Rep. of Korea

[73] Assignee: Samsung Electronics Co., Ltd., Suwon, Rep. of Korea

[21] Appl. No.: 09/076,133

[22] Filed: May 12, 1998

[30] Foreign Application Priority Data

May 15, 1997 [KR] Rep. of Korea ..... 97-18676
May 15, 1997 [KR] Rep. of Korea ..... 97-18677

[51] Int. Cl.[7] ..... F25D 21/08

[52] U.S. Cl. ..... 62/151; 62/131; 62/276

[58] Field of Search ..... 62/131, 151, 156, 62/180, 186, 187, 275, 276

[56] References Cited

U.S. PATENT DOCUMENTS

| | | | |
|---|---|---|---|
| 1,726,631 | 9/1929 | Shipman . | |
| 3,108,450 | 10/1963 | Crotser | 62/182 X |
| 3,425,236 | 2/1969 | Streed et al. | 62/275 X |
| 4,203,301 | 5/1980 | Gill et al. | 62/131 |
| 4,379,391 | 4/1983 | Rhee . | |
| 4,569,205 | 2/1986 | Dempou et al. . | |
| 4,732,010 | 3/1988 | Linstromberg et al. . | |
| 4,879,878 | 11/1989 | Polkinghorne | 62/187 |
| 5,269,152 | 12/1993 | Park . | |

FOREIGN PATENT DOCUMENTS

| | | |
|---|---|---|
| 0 872 696 | 10/1998 | European Pat. Off. . |
| 0 872 697 | 10/1998 | European Pat. Off. . |
| 54-053137 | 4/1954 | Japan . |
| 59-36491 | 3/1984 | Japan . |
| 8-504939 | 5/1996 | Japan . |

*Primary Examiner*—Harry B. Tanner
*Attorney, Agent, or Firm*—Burns, Doane, Swecker & Mathis, L.L.P.

[57] ABSTRACT

A refrigerator having a shutting device for preventing flow of air between an evaporator and a fresh food compartment is disclosed. The shutting device has a shutting member for shutting a space that the evaporator is installed against a cooling compartment, and a motor for driving the shutting member. During a defrosting operation and when the door is open, cool air discharge ports are closed by the shutting member. Thus, the temperature rise of the fresh food compartment due to the heat from a defrosting heater, and the loss of cool air and the generation of frost on the evaporator due to the opening of the door are prevented.

3 Claims, 3 Drawing Sheets

REFRIGERATOR HAVING A DEVICE FOR PREVENTING FLOW OF AIR BETWEEN AN EVAPORATOR AND A COOLING COMPARTMENT

BACKGROUND OF THE INVENTION

1. Field of the Invention

The present invention relates to a refrigerator, and more particularly, to a refrigerator which has a device for preventing flow of air between an evaporator and a cooling compartment during a defrosting operation and when a door is open.

2. Related Art

In general, as shown in FIG. 1, a refrigerator has a compressor 14 for compressing refrigerant, an evaporator 7 for generating cool air by evaporating the refrigerant supplied from the compressor 14, and a fan 10 for blowing the cool air generated by the evaporator 7. A duct member 12 for forming a cool air duct is installed at the rear part of a fresh food compartment 3. The duct member 12 has a plurality of cool air discharge ports 13 opened in the fresh food compartment 3. The cool air blown by the fan 10 flows into the cool air duct, and then is supplied into the fresh food compartment 3 through the cool air discharge ports 13.

The fresh food compartment 3 is opened and closed by a door 2, and the fresh food compartment 3 is partitioned into a plurality of spaces by shelves 4. At the upper part of the fresh food compartment 3, a cover 5 for shielding the evaporator 7 is installed. The evaporator 7 is fixed by a holder 8 in a space 6 formed by the cover 5.

While the refrigerator operates, frost is generated on the evaporator 7. The cooling efficiency of the evaporator 7 is lowered by the frost. Hence, the refrigerator is equipped with a heater 9 for removing the frost, and performs defrosting operation by heating the evaporator 7 using the heater 9 when the refrigerator is used more than a predetermined period of time.

In such a conventional refrigerator, there is a problem that the heat generated by the heater 9 during the defrosting operation is transmitted into the fresh food compartment 3. The heat generated by the heater 9 is mainly transmitted through the same path with the path for supplying the cool air. That is, the heat is mainly transmitted to the fresh food compartment 3 through the cool air duct and the cool air discharge ports 13. Due to the heat transmitted to the fresh food compartment 3, the cooling efficiency of the fresh food compartment 3 is lowered, and the status of the food stored therein cannot be maintained properly.

Furthermore, there is a problem that the cool air generated by the evaporator 7 is continuously supplied into the fresh food compartment 3 even when the door 2 is open, so the supplied cool air flows outside, which is a loss of the cool air. Furthermore, outside warm air flows toward the evaporator 7 of which surroundings lie in a lower pressure than the other areas, whereby more frost is generated on the evaporator 7. Therefore, the defrosting operation must be performed more frequently. In order to perform the defrosting operation, the heater 9 should radiate heat, so the cooling efficiency is still more lowered by the frequent defrosting operation.

SUMMARY OF THE INVENTION

The present invention has been proposed to overcome the above described problems in the prior art, and accordingly it is the object of the present invention to provide a refrigerator which can prevent the transmission of heat generated by a defrosting heater during the defrosting operation thereof into a cooling compartment and can prevent flow of air between the cooling compartment and the evaporator when the door is open, whereby the cooling efficiency is enhanced.

To achieve the above object, the present invention provides a refrigerator comprising: a body forming a cooling compartment; an evaporator for generating cool air to be supplied into a cooling compartment by evaporating refrigerant; a heater for defrosting the evaporator; a door for opening/closing the cooling compartment; a means for sensing opening and closing of the door; and a device for shutting a space that the evaporator is installed against the cooling compartment during a defrosting operation of the heater and/or when an opening of the door is sensed by the sensing means.

Here, the shutting device comprises: a shutting member being formed with a plurality of air holes corresponding to a plurality of cool air discharge ports opened in the cooling compartment; a motor for driving the shutting member; and a control part for controlling the motor to open/close the cool air discharge ports with the shutting member. The control part controls the fan so that operation of the fan is stopped when the door is open.

Preferably, the shutting device releases a shutting state when a temperature of the evaporator falls down below a predetermined temperature after the defrosting operation of the heater ends.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
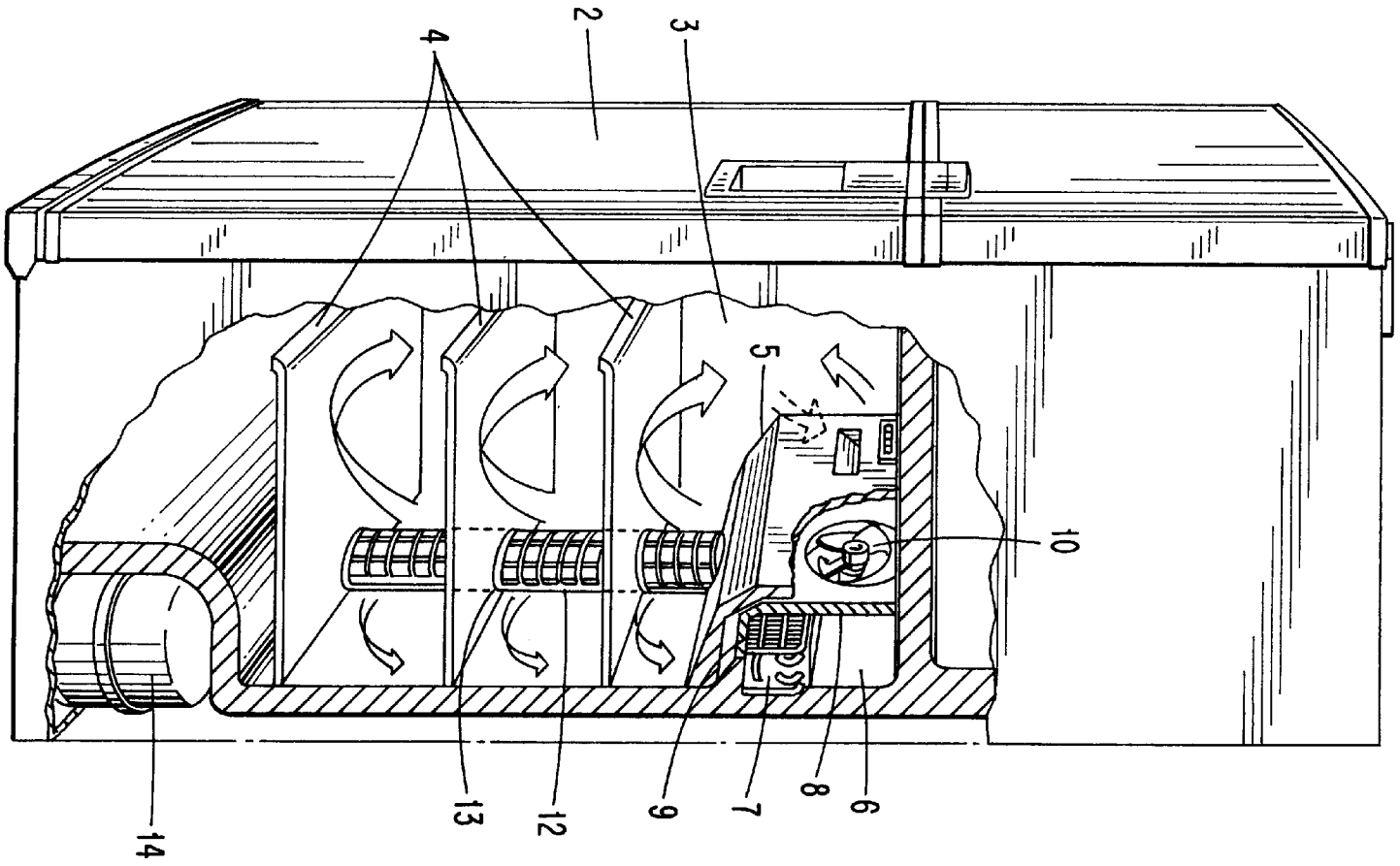
FIG. 1 (PRIOR ART)
FIG. 1 is a partial cutaway perspective view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
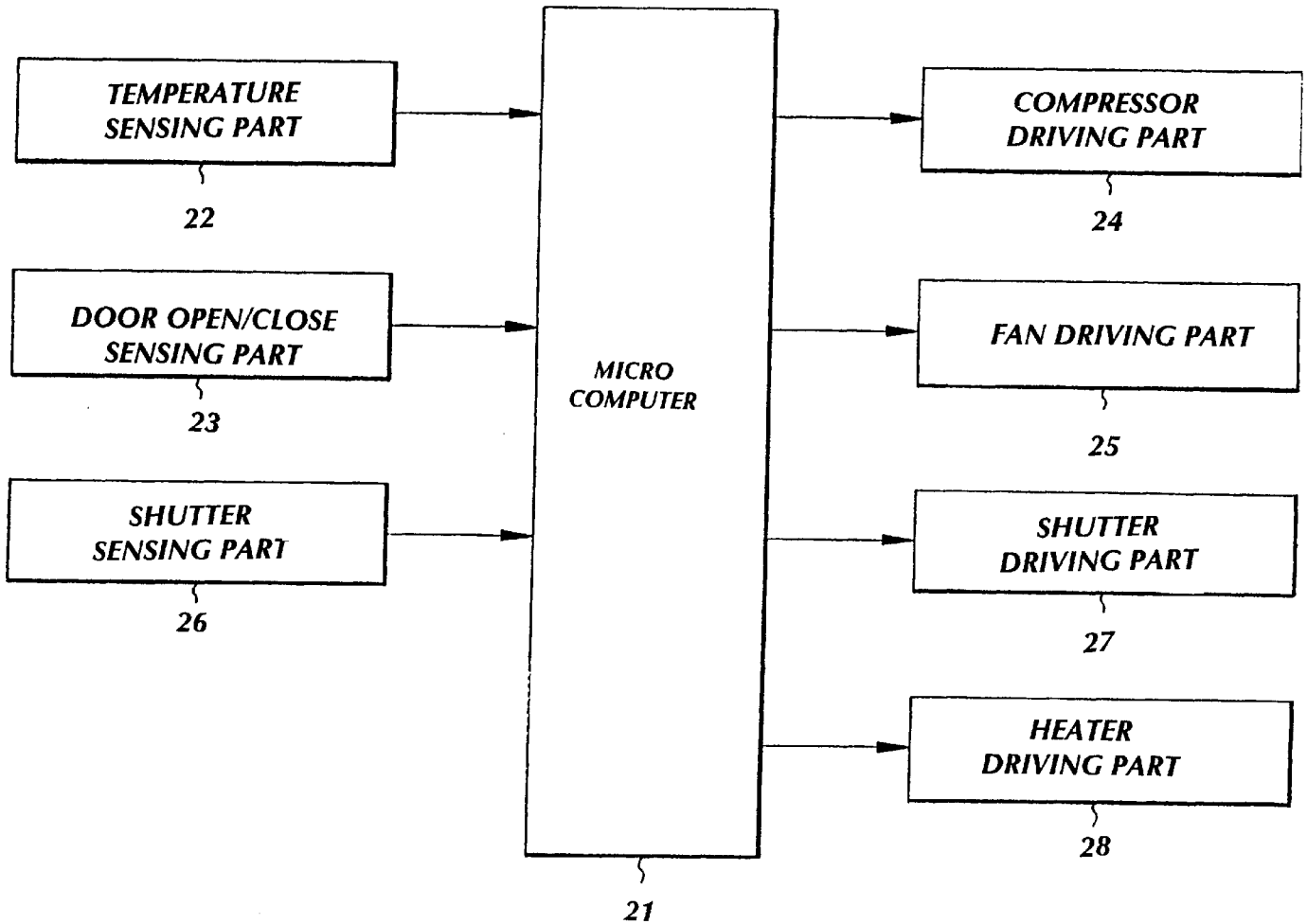
FIG. 2 is a block diagram of a refrigerator according to the present invention.

FIG. 2 is a block diagram of a refrigerator according to the present invention. The refrigerator according to the present invention has a temperature sensing part 22 for sensing the temperature in the fresh food compartment 3, a door open/close sensing part 23 for sensing the opening/closing of the door 2, a microcomputer 21 for controlling overall operation of the refrigerator, a compressor driving part 24 for driving the compressor 14, a fan driving part 25 for driving fan 10, a heater driving part 28 for driving the heater 9, and a shutter sensing part 26 and a shutter driving part 27 for driving a shutting device 30 which will be described later.

The temperature sensing part 22 is comprised of a plurality of temperature sensors (not shown) installed in the fresh food compartment 3. The door open/close sensing part 23 is generally implemented by a push button switch (not shown) installed at the frontal side of the fresh food compartment 3, which is pushed when the door 2 is close and released when the door 2 is open. The signals from the temperature sensing part 22, the door open/close sensing part 23, and the shutter sensing part 26 are inputted to the microcomputer 21, and the microcomputer 21 controls the compressor driving part 24, the fan driving part 25, and the shutter driving part 27 on the basis of the inputted signals.

Figure 4:
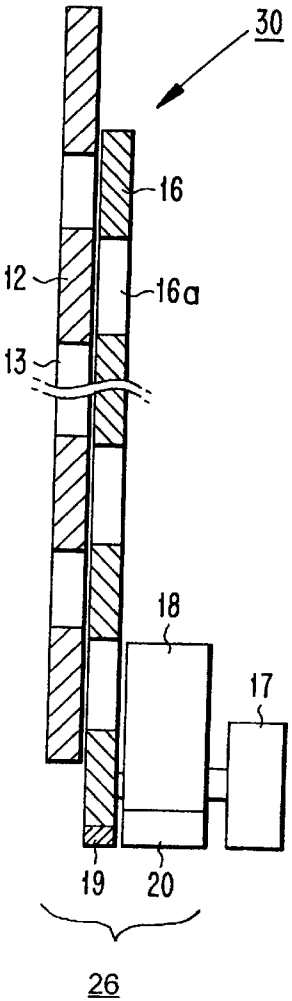
FIGS. 3 and 4 are enlarged side sectional views of a shutting device of a refrigerator for preventing transmission of heat according to the present invention.
Figure 3:
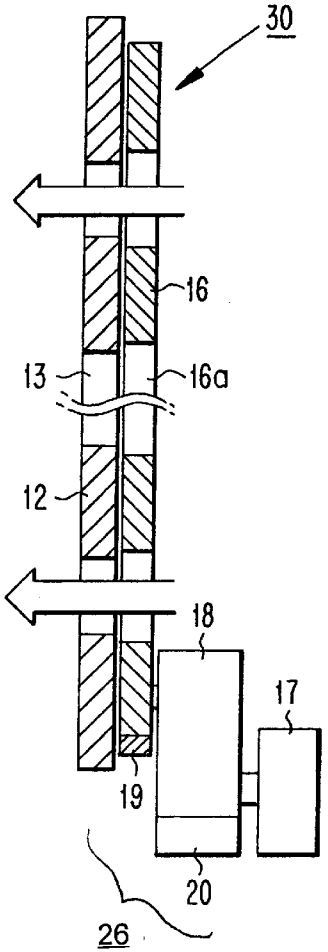

The shutting device 30 of the refrigerator is, as shown in FIGS. 3 and 4, comprised of a shutting member 16 being disposed closely to the duct member 12 and for opening/closing the cool air discharge ports 13, a motor 17 being driven by the shutter driving part 27 and for driving the shutting member 16, and a power transmission 18 for transmitting the power of the motor 17.

The shutting member 16 is formed with a plurality of air holes 16*a*. According to the position of the shutting member 16, the cool air discharge ports 13 of the duct member 12 are open as shown in FIG. 3, or close as shown in FIG. 4.

The power transmission 18 is comprised of a cam and gears, which converts rotational movement of the motor 17 to up-and-down movement of the shutting member 16.

The shutter sensing part 26 shown in FIG. 2 is comprised of a reed switch 20 and a magnet 19 for driving the reed switch 20. The reed switch 20 is installed at the lower part of the power transmission 18, and the magnet 19 is installed at the lower part of the shutting member 16. When the shutting member 16 is moved down by the operation of the motor 17, the cool air discharge ports 13 are close as shown in FIG. 4, whereby the reed switch 20 is turned on by the magnet 19. Then, the microcomputer 21 senses the completion of the closing operation of the shutting member 16, and stops operating the motor 17.

The fan driving part 25 and the heater driving part 27 are controlled by the microcomputer 21, and drive the fan 10 and the heater 9 respectively.

Hereinbelow, the operation of the refrigerator equipped with such a shutting device 30 according to the present invention will be described.

The microcomputer 21 controls the compressor driving part 24 and the fan driving part 25 on the basis of the signals from the temperature sensing part 22. In other words, when the temperature in the fresh food compartment is higher than a temperature set by a user, the microcomputer 21 operates the compressor 14 and the fan 10, and thereby the evaporator 7 generates cool air and the cool air is supplied into the fresh food compartment 3 by the fan 10.

The microcomputer 21 calculates the duration time of cooling operation of the refrigerator, that is, the duration time that the cool air is generated by the evaporator 7 by the operation of the compressor 14. When the calculated duration time reaches a predetermined time, the microcomputer 21 controls the compressor driving part 24 and the fan driving part 25 so that the compressor 14 and the fan 10 stop operating, and then performs the defrosting operation of the evaporator 7. At first, the microcomputer 21 drives the driving motor 17 so that the cool air discharging ports 13 are closed by the shutting member 16 as shown in FIG. 4. Then the microcomputer 21 controls the heater driving part 28 to operate the heater 9. The frost generated on the evaporator 7 is removed by the heat of the heater 9.

After performing the defrosting operation for some time, the microcomputer 21 stops the heating operation of the heater 9. The microcomputer 21 maintains the cool air discharge ports 13 to be opened by the shutting member 16 once a predetermined time elapses after the operation of the heater 9 is stopped.

That is, once the operations of the compressor 14 and the heater 9 are stopped, the microcomputer 21 operates the compressor 14 again to perform the operation of the evaporator 7 for generating the cool air. After the operation of the evaporator 7 for generating the cool air is performed for a predetermined time, the microcomputer 21 drives the motor 17 so that the cool air discharge ports 13 are opened by the shutting member 16 as shown in FIG. 3. In this situation, the predetermined time is the time that is sufficient for the temperature of the evaporator 7 to be lowered below the temperature of the fresh food compartment 3. Since the flow of the heat generated by the heater 9 during the defrosting operation into the fresh food compartment 3 is prevented by the shutting device 30, the temperature of the fresh food compartment 3 is maintained properly, and in particular, since the cool air discharge ports 13 are opened after the temperature of the evaporator 7 is sufficiently lowered, the temperature of the fresh food compartment 3 is efficiently preserved.

While the refrigerator operates, when the opening of the door 2 is sensed by the door open/close sensing part 23, the microcomputer 21 controls the fan driving part 25 to stop operating the fan 10 and controls the shutter driving part 27 to shut off the cool air discharge ports 13. In other words, the microcomputer 21 stops operating the fan 10 through the fan driving part 25, and drives the driving motor 17 through the shutter driving part 27. Then, the shutting member 16 is moved down and the cool air discharge ports 13 are shut off by the shutting member 16 as shown in FIG. 4. The shutter sensing part 26 senses the close of the cool air discharge ports 13, and then the microcomputer 21 controls the shutter driving part 27 to stop operating the motor 17. While the door open/close sensing part 23 senses that the door 2 is open, the microcomputer 21 keeps the close state of the cool air discharge ports 13.

According to such a processes, the space in which the evaporator 7 is installed is shut against the fresh food compartment 3 when the door 2 is open. Therefore, the supply of cool air into the fresh food compartment is stopped, and thereby the loss of the cool air caused by the leakage of the cool air is prevented. Furthermore, the outside warm air flowing into the fresh food compartment 3 does not flow toward the evaporator 7. Therefore, the frost caused by the outside warm air is not generated on the evaporator 7, so the cooling efficiency of the evaporator 7 is enhanced and the frequent defrosting operation is not required.

When the close of the door 2 is sensed by the door open/close sensing part 23, the microcomputer 21 controls the shutter driving part 27 to open the cool air discharge ports 13 as shown in FIG. 3, and controls the fan driving part 25 to resume the operation of the fan 10. The microcomputer 21 controls again the compressor driving part 24 and the fan driving part 25 on the basis of the sensing result of the temperature sensing part 22. Then, the operation of the refrigerator is normally performed.

As described above, according to the present invention, the heat does not flow into the fresh food compartment during the defrosting operation, and the loss of the cool air and the generation of frost due to the opening of the door is prevented.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a body forming a cooling compartment;

an evaporator for generating cool air to be supplied into said cooling compartment by evaporating refrigerant;

a duct member forming a cool air duct for guiding the cool air generated from said evaporator, said duct member being formed with a plurality of cool air discharge ports opened in said cooling compartment;

a heater for defrosting said evaporator;

a door for opening/closing said cooling compartment;

a means for sensing opening and closing of said door;

a shutting member formed with a plurality of air holes and movable between a port-open position and a port-closed position for opening/closing said discharge ports, respectively:

a motor for driving said shutting member between said port-open and port-closed positions;

a power transmission for transmitting a power of said motor to said shutting member;

a shutter sensor for sensing a position of said shutter member, said shutter sensor including a reed switch installed at a lower part of said power transmission and a magnet installed at a lower part of said shutting member to drive said reed switch when said magnet travels adjacent thereto; and control means for:

controlling said motor to move said shutter member to said port-closed position during a defrosting operation of said heater and/or when said sensor senses said door being open, stopping said motor in response to said sensor sensing said shutter member in said port-closed position, and controlling said motor to move said shutter member to said port-open position after a delay following a defrosting operation, to enable the evaporator temperature to be reduced before air is supplied thereto.

2. The refrigerator as claimed in claim 1, further comprising a fan for blowing the cool air generated by said evaporator into said cooling compartment; wherein said control part controls said fan so that operation of said fan is stopped when said door is open.

3. The refrigerator according to claim 1 wherein said shutter member comprises a plate arranged for vertical sliding movement against a surface of said duct member through which said cool air discharge ports are formed.

* * * * *